US007946780B2

(12) United States Patent
Zhang

(10) Patent No.: US 7,946,780 B2
(45) Date of Patent: May 24, 2011

(54) COSMETIC DISPENSER

(76) Inventor: Derik Zhang, Hanzhong (CN)

( * ) Notice: Subject to any disclaimer, the term of this patent is extended or adjusted under 35 U.S.C. 154(b) by 889 days.

(21) Appl. No.: 11/873,140

(22) Filed: Oct. 16, 2007

(65) Prior Publication Data

US 2008/0112752 A1 May 15, 2008

(51) Int. Cl.
*A46B 11/04* (2006.01)
*A47L 13/22* (2006.01)

(52) U.S. Cl. ..... 401/277; 401/175; 401/286

(58) Field of Classification Search ..... 401/169, 401/174, 175, 187, 269, 277, 280, 281, 286; 222/390, 153.14
See application file for complete search history.

(56) References Cited

U.S. PATENT DOCUMENTS

| | | | | |
|---|---|---|---|---|
| 3,420,417 | A | 1/1969 | Kardel | |
| 4,071,300 | A | 1/1978 | Nichols et al. | |
| 5,025,960 | A | 6/1991 | Seager | |
| 5,026,192 | A | 6/1991 | Kiuchi et al. | |
| 5,372,444 | A * | 12/1994 | Lhuisset | 401/175 |
| D379,927 | S | 6/1997 | Crawford | |
| D381,899 | S | 8/1997 | Crawford | |
| 5,725,133 | A | 3/1998 | Iaia | |
| 5,738,067 | A | 4/1998 | Landwehr et al. | |
| D412,839 | S | 8/1999 | Wilson et al. | |
| D412,840 | S | 8/1999 | Wilson et al. | |
| D414,105 | S | 9/1999 | Wilson et al. | |
| 5,992,705 | A | 11/1999 | Lhuisset | |
| 6,003,603 | A | 12/1999 | Breivik et al. | |
| 6,039,483 | A | 3/2000 | Szekely | |
| 6,210,061 | B1 | 4/2001 | Johnson | |
| 6,499,900 | B1 | 12/2002 | Brozell | |
| 6,533,482 | B1 | 3/2003 | Byun | |
| 6,688,793 | B2 | 2/2004 | Goyet | |
| 6,964,357 | B2 | 11/2005 | Manganini | |
| 7,144,175 | B2 | 12/2006 | Biegel | |
| 7,213,994 | B2 | 5/2007 | Phipps et al. | |
| 7,731,440 | B2 * | 6/2010 | Tani | 222/390 |
| 2005/0111901 | A1 | 5/2005 | Tintore Belil | |

FOREIGN PATENT DOCUMENTS

| | | |
|---|---|---|
| DE | 4016353 | 12/1990 |

* cited by examiner

*Primary Examiner* — Tuan N Nguyen
(74) *Attorney, Agent, or Firm* — Amster, Rothstein & Ebenstein LLP

(57) ABSTRACT

A cosmetic dispenser comprises a brush, a cylinder, a ratchet wheel comprising internal ratchets and external ratchets, a rotating sleeve including a cosmetic reservoir and a piston. The brush is attached to the cylinder, which is rotatably attached to the revolving sleeve. The ratchet wheel is attached to the end of the cylinder disposed inside the revolving sleeve. The piston extends through the ratchet wheel and has a piston head disposed in the cosmetic reservoir of the revolving sleeve. An axial tunnel extends the entire length of the piston and communicates with a cosmetic reservoir. A needle extends from the brush into the piston axial tunnel. This cosmetic dispenser is constructed in such a way that, relative rotation of the cylinder and the rotating sleeve in a dispensing direction results in displacement of the piston head into the cosmetic reservoir and pressurized flow of a liquid cosmetic from the cosmetic reservoir to the brush. In addition, relative rotation of the cylinder and the rotating sleeve in a non-dispensing direction causes no displacement of the piston.

16 Claims, 7 Drawing Sheets

COSMETIC DISPENSER

BACKGROUND OF INVENTION

The present invention relates to a cosmetic dispensing device, more particular to a improved structure for the controlled release of a cosmetic from a reservoir into an attached application brush.

Examples from the prior art include U.S. Patent Publication 2005/0111901 to Belil, U.S. Pat. No. 5,025,960 to Seager and U.S. Pat. No. 4,071,300. Each of these prior art references disclose a reservoir into which is disposed a hollow, externally threaded cylinder. Rotation of the cylinder causes an internally threaded plunger to be displaced into the reservoir, creating pressure inside the reservoir and forcing the liquid in the reservoir through the open bottom of the operating cylinder. The top of the operating cylinder is attached to a dispensing portion and the liquid displaced from the reservoir is guided through the cylinder to the dispensing portion.

The conventional structure of a cosmetic dispensing unit, as seen in each of the three above identified prior art references, comprises a lid or cover part, driving parts and a rotating part, wherein the driving parts are connected to a piston so that the piston moves by turning the rotating part to push liquid cosmetic from a reservoir inside the dispensing unit to a dispensing portion, e.g. a brush, used for applying the cosmetic.

The rotating part in the conventional structure is either the lid or is attached to the lid. Thus, it is exposed and permits accidental cosmetic leaks, i.e. by transmitting vibration to the driving structures when the lip pencil is left in a handbag.

In addition, the driving parts of the conventional structure may be rotated in the wrong direction. Such a driving action results in the piston being driven and moving in the wrong direction so that air is sucked into the reservoir or a vacuum is created in the reservoir. In either case, rotation in the proper direction after improper rotation will require an excessive number of rotations and may result in over dispensing of cosmetic by way of the excessive rotations or due to entrapped air. Some conventional cosmetic dispensers compensate for this by allowing the dispenser to be rotated only in one direction in order to avoid forming the vacuum inside the reservoir. This avoids cosmetic backing up into the reservoir and the undesirable condition that the dispensing of excessive cosmetic due to compressed entrapped air. However, consumers may attempt to rotate the rotating part in either direction in use and, thus, if the lip pencil can be rotated only in one direction some users may perceive that too much cosmetic is being dispensed as compared to a dispenser that can be turned in either direction. The user's misperception of a 'broken' dispenser is also avoided.

With the configuration of the driving parts of the conventional cosmetic dispenser, the dispenser must necessarily have a cylindrical cross section, thereby resulting in a limited number of shapes and configurations.

SUMMARY OF THE INVENTION

The objective of the invention is to provide a modified structure of a novel lip pencil, intending to overcome these shortcomings of the prior art.

In order to achieve the objective, the present invention is a cosmetic dispenser comprising a cosmetic applicator, such as a brush or sponge, attached to a first end of a cylinder, the cylinder also having an operating end and an internally threaded hole passing through the operating end. Operating end ratchets are provided on an external surface of the operating end. A ratchet wheel having an annular wall and an end wall, the annular wall and end wall defining a cavity, the end wall having an axial hole therethrough, the annular wall comprising internal ratchets on an internal wall and external ratchets on an external wall, wherein the operating end of the cylinder extends into the cavity of the ratchet wheel such that the ratchet wheel internal ratchets are adjacent the operating end ratchets. The cylinder is rotatably attached to a revolving sleeve with the operating end and attached ratchet wheel disposed inside the revolving sleeve, the revolving sleeve having revolving sleeve ratchets on an internal annular wall adjacent the external ratchets of the ratchet wheel. A piston is also provided, comprising a piston head and an externally threaded rod. The rod extends through the ratchet wheel axial hole and the operating end internally threaded hole with the external thread of the rod threadingly engaging the operating end internally threaded hole. The rod further having a distal end attached to the piston head. The piston head is disposed in the revolving sleeve. The ratchet wheel axial hole and rod comprise cross sections such that relative rotational displacement is prevented but relative axial displacement is possible. An axial tunnel extends the entire length of the piston, through the rod and piston head, and communicates with a cosmetic reservoir defined by the revolving sleeve and piston head. A needle extends axially through the cylinder and is secured at a first needle end to the brush, the second needle end extends into the piston axial tunnel at a proximal end of the rod. This cosmetic dispenser is constructed in such a way that, relative rotation of the cylinder and the rotating sleeve in a dispensing direction causes the revolving sleeve internal ratchets, through the ratchet wheel external ratchets, to turn the externally threaded rod and the engagement of the externally threaded rod with the internally threaded hole in the operating end, resulting in displacement of the piston head into the cosmetic reservoir and pressurized flow of a liquid cosmetic from the cosmetic reservoir, through the piston axial tunnel and needle, into the brush. In addition, relative rotation of the cylinder and the rotating sleeve in a non-dispensing direction causes the operating end external ratchets to turn the ratchet wheel by way of the ratchet wheel internal ratchets, thus resulting in no relative rotation between the internally threaded hole of the operating end, the ratchet wheel and, thus, the externally threaded rod and no displacement of the piston The ratchet wheel axial hole may be shaped like a racetrack, while the cross section of externally threaded rod is also shaped like a race track, thus enabling the relative rotational restriction and axial movement between the ratchet wheel and the rod.

Any portion of the driving means of the present invention may be of any resilient material.

The cosmetic dispenser may also include a lid removably disposed over the brush. The revolving sleeve can be provided with a lid attachment means which allows rotation of the lid relative to the revolving sleeve but such rotation of the lid will not cause rotation of the cylinder relative to the revolving sleeve.

The cross-section of the cosmetic dispensing device need not be circular. As long as the effective portions of the driving means are round, any structure attached thereto can be of any cross-sectional shape.

DETAILED DESCRIPTION OF THE PREFERRED EMBODIMENT

Figure 1:
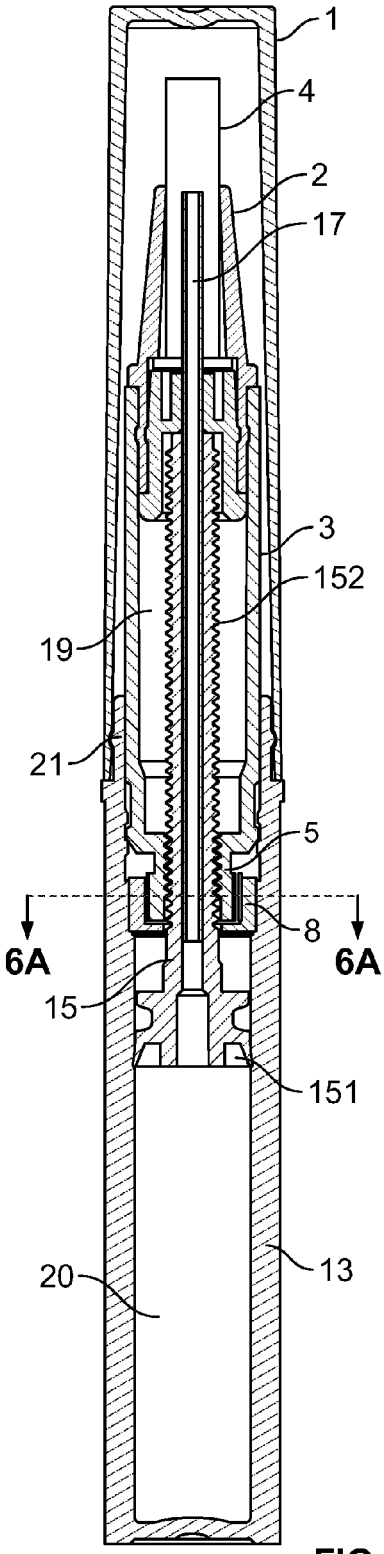
FIG. 1 is a schematic cross-sectional view of the cosmetic dispensing lip pencil.

FIGS. 1-7 disclose a cosmetic dispensing pencil according to one embodiment of the present invention. The cosmetic dispensing pencil has a lid or cover 1, a brush head 2, an operating cylinder 3 and a brush 4. The brush 4 is attached to the brush head 2 which is, in turn, attached to or integral with one end of the operating cylinder 3. The operating end 5 is located at the other end of the operating cylinder 3. Brush 4 may, alternatively, be any liquid permeable material capable dispensing a liquid cosmetic, i.e. a cosmetic applicator.

Operating cylinder 3 is attached adjacent its operating end 5 to revolving sleeve 13. Encompassed by the revolving sleeve 13 is a cosmetic reservoir 20, piston 15 and driving means for the piston 15. The driving means is activated by relative rotation of the operating cylinder 3 and revolving sleeve 13, i.e. the person utilizing the cosmetic pencil grips the operating cylinder 3 in one hand, holding it in place, while twisting the revolving sleeve 13 with the other hand. As a result of this relative rotation, the driving means causes piston 15 to be forced into the cosmetic reservoir 20. The increase in pressure in the cosmetic reservoir 20 causes the liquid cosmetic to be forced through a pair of conduits, these conduits deliver the liquid cosmetic to the brush 4. A detailed description of the conduits and driving means follows.

Figure 4:
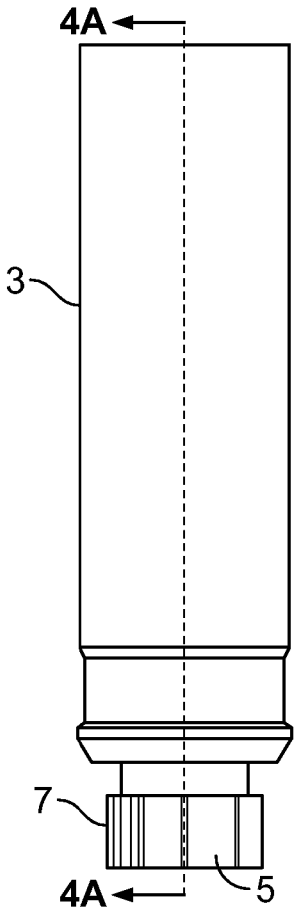
FIG. 4 is a schematic view of the operating cylinder.
Figure 4A:
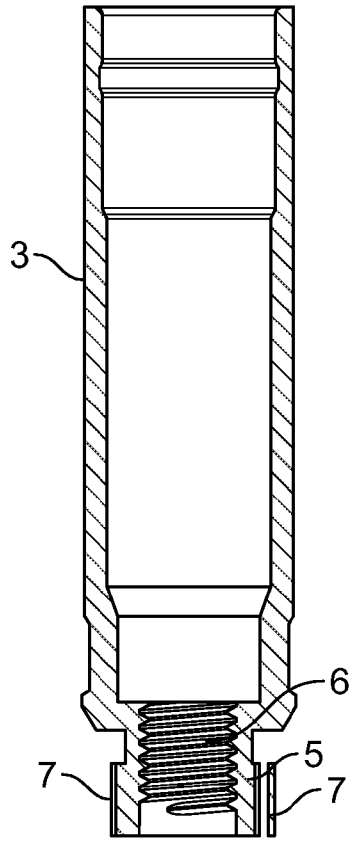
FIG. 4A is a schematic cross-sectional view taken along line A-A of FIG. 4.

As shown in FIGS. 4 and 4A, operating cylinder 3 has an operating end 5 that is closed except for an internally threaded through-hole 6. Internally threaded through-hole 6 extends axially through the operating end 5, connecting hollow chamber 19 of cylinder 3 to cosmetic reservoir 20. Internally threaded through-hole 6 forms a portion of the transmission of the driving means; through-hole 6 converts a twisting force into a piston driving force. The external surface of the operating end 5 has operating end ratchets 7 formed thereon. These operating end ratchets 7 selectively transmit the twisting force to the internal threads of through-hole 6. The source of the twisting force and its conversion to a piston driving force will be described below.

Figure 5:
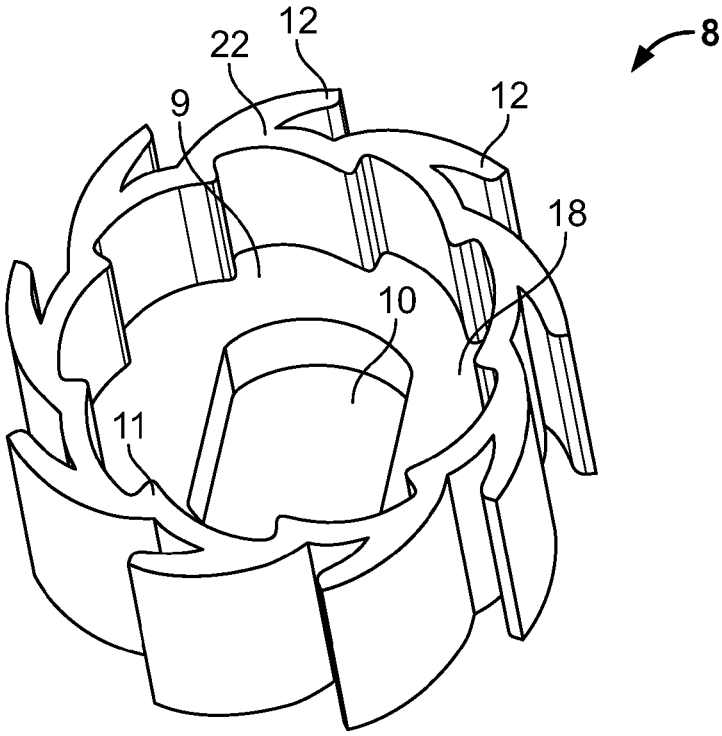
FIG. 5 is a perspective view of one embodiment the ratchet wheel.
Figure 6:
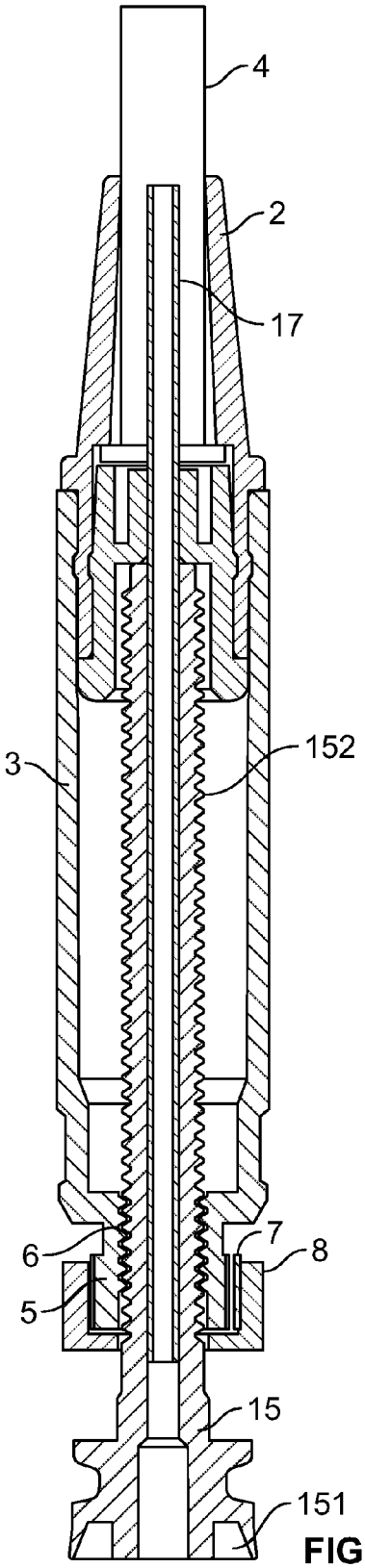
FIG. 6 is a schematic cross-sectional view of the operating cylinder of FIG. 4, brush, brush head, piston of FIG. 3 and ratchet wheel of FIG. 5 assembled together.

As shown in FIG. 5, ratchet wheel 8 has an end wall 18 and a peripheral ratchet wall 22. The peripheral ratchet wall 22 and end wall 18 define a cavity 9. A hole 10 extends through end wall 18 and into cavity 9. Hole 10 through ratchet wheel end wall 18 is shaped like a racetrack, i.e. two equal length parallel straight sides opposite one another with their ends joined by semicircles opposite one another. Peripheral ratchet wall 22 has internal ratchets 11 and external ratchets 12. Internal ratchets 11 are on the side of peripheral ratchet wall 22 adjacent cavity 9. External ratchets 12 are provided on the external peripheral surface of the ratchet wheel 8. Ratchet wheel 8 is disposed over the operating end 5 of cylinder 3. As best seen in FIG. 6, a portion of the operating end 5 extends into cavity 9 of ratchet wheel 8 such that internal ratchets 11 are engaged with the operating end ratchets 7 on the external surface of the operating end 5.

Figure 2:
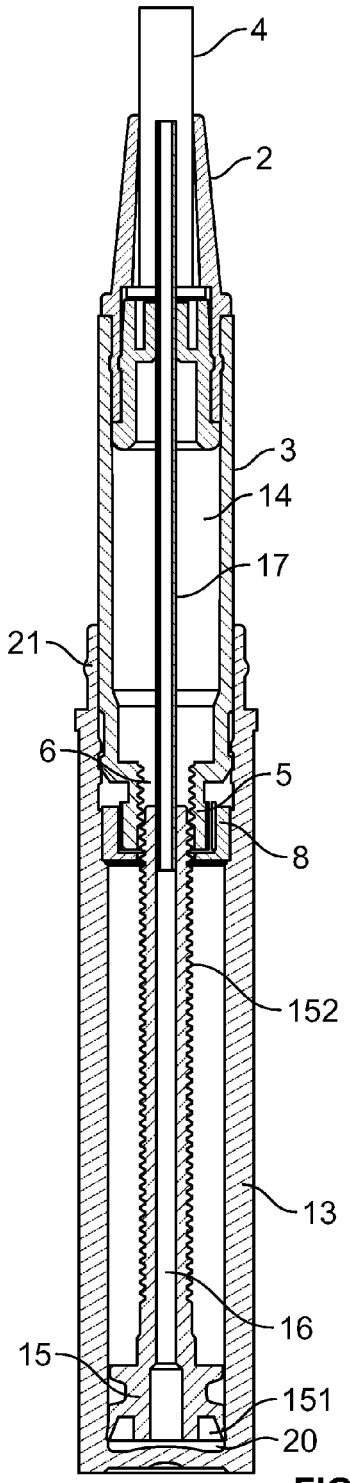
FIG. 2 is a schematic cross-sectional view similar to FIG. 1, with the lid removed and piston extended into the cosmetic reservoir.
Figure 7:
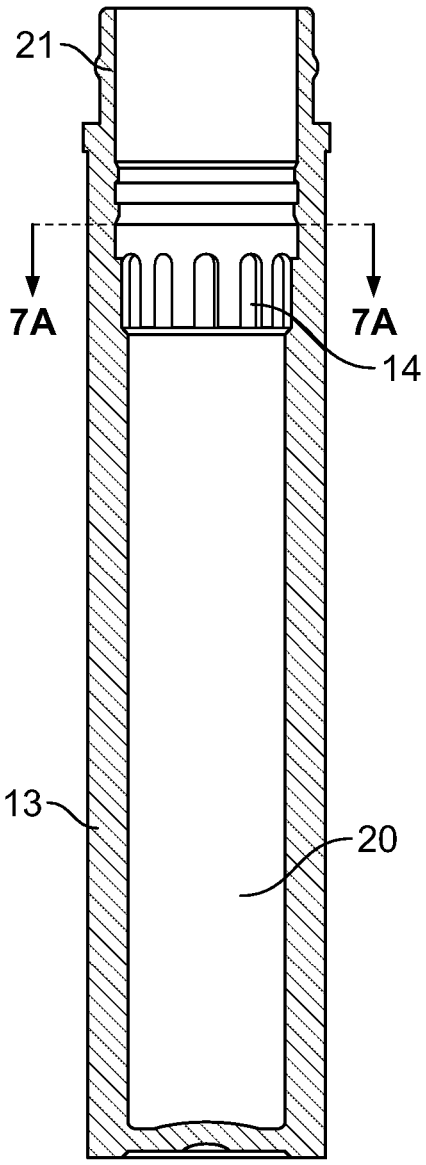
FIG. 7 is a schematic cross-sectional view of the revolving sleeve.
Figure 7A:
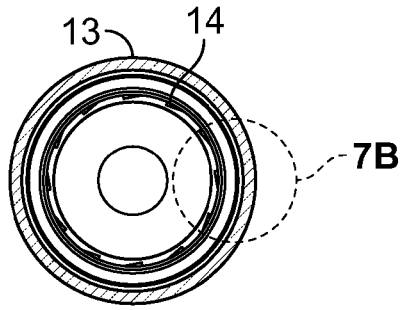
FIG. 7A is a schematic cross-sectional view taken along line A-A of FIG. 7.
Figure 7B:
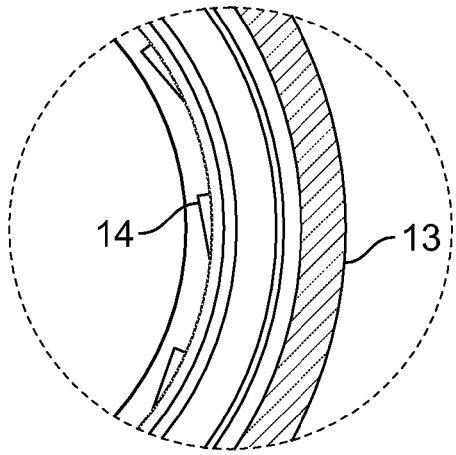
FIG. 7B is a detail view of FIG. 7A showing the revolving sleeve ratchets.

FIGS. 1 and 2 show operating cylinder 3 rotatably attached to revolving sleeve 13. Operating end 5 and attached ratchet wheel 8 are encompassed inside revolving sleeve 13 when revolving sleeve is attached to operating cylinder 3. Revolving sleeve 13 has ratchets 14, best shown in FIGS. 7, 7A and 7B, formed on an internal surface thereof. These revolving sleeve ratchets 14 engage the external ratchets 12 of the ratchet wheel 8.

Figure 3:
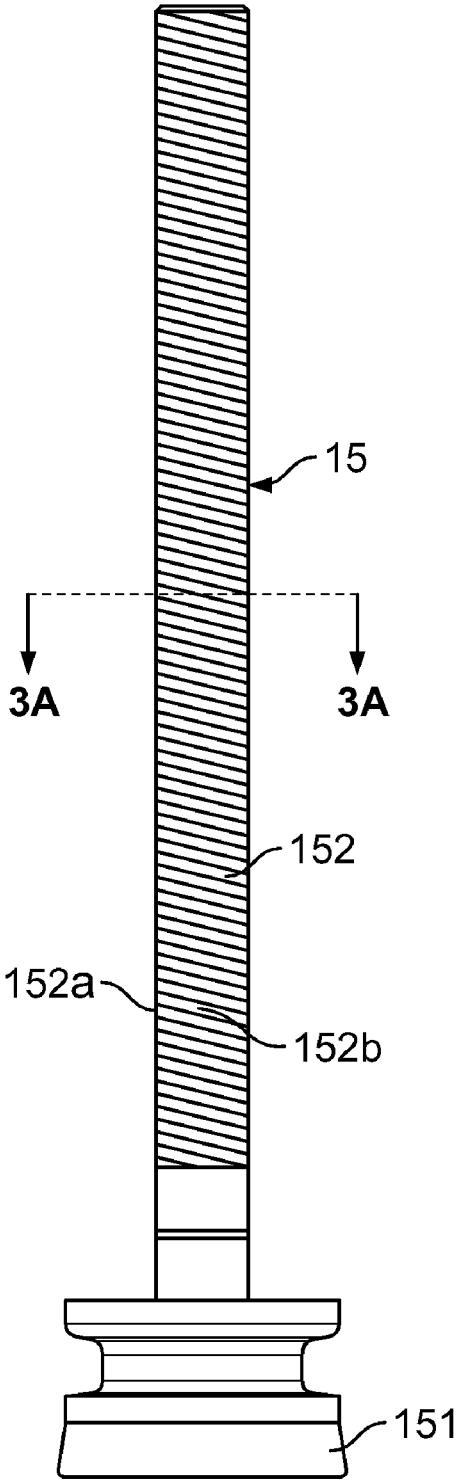
FIG. 3 is a schematic view of the piston.
Figure 3A:
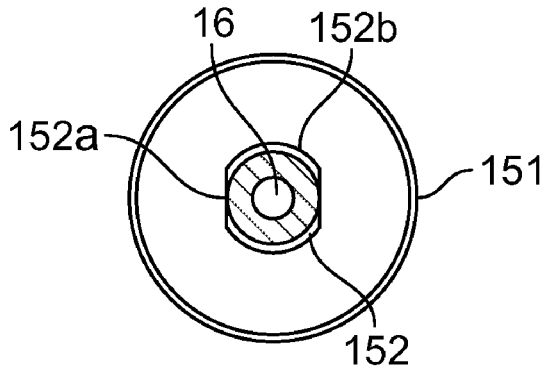
FIG. 3A is a schematic cross-sectional view taken along line A-A of FIG. 3.

FIG. 3 discloses piston 15, which includes a piston head 151 attached to an externally threaded rod 152. An axial tunnel 16 (shown in FIG. 2) extends the entire length of rod 152 and entirely through piston head 151. FIG. 3A is cross section of externally threaded rod 152 of piston 15. Threaded rod 152 has two flat portions 152A connected by two round, threaded portions 152B. This shape is complementary to the racetrack hole 10 of ratchet wheel 8 and its purpose will be further discussed below.

FIG. 6 shows piston 15, ratchet wheel 8 and operating cylinder 5 assembled in accordance with the present invention. Externally threaded rod 152 engages the internally threaded through-hole 6 of operating end 5 and passes therethrough. The piston head 151 is attached at a distal end of the threaded rod 152, i.e. the end designed to extend into revolving sleeve 13. Externally threaded rod 152 also passes through hole 10 on the ratchet wheel 8, with the proximal end of the threaded rod 152 extending into the cylinder 3. The externally threaded rod 152 engages, through the external male thread thereof, the female thread of the internally threaded through-hole 6. At the distal end of piston 15, axial tunnel 16 of threaded rod 152 leads directly into cosmetic reservoir 20, as seen in FIGS. 1 and 2. Thus, the contents of cosmetic reservoir 20 may flow into axial tunnel 16 through its distal end.

Cosmetic reservoir 20 is the portion of revolving sleeve 13 below piston head 151 in the orientation of FIGS. 1 and 2. FIG. 1 thus shows cosmetic reservoir 20 at or near its maximum volume while FIG. 2 shows cosmetic reservoir 20 at or near its minimum volume.

A needle or similar conduit 17 is secured to the brush head 2 at one end; the other end of the needle 17 extends into axial tunnel 16 of piston rod 152. Thus, the central bore of the needle is in communication at one end thereof with the brush 4 and at the other end thereof with the axial tunnel 16 of the piston 15. Thus, the contents of cosmetic reservoir 20 may be conveyed to brush 4 through axial tunnel 16 of piston 15 and central bore of needle 17.

As stated above, hole 10 through ratchet wheel end wall 18 is shaped like a racetrack, i.e. two straight sides and two semicircular sides and the cross section of externally threaded rod 152 of piston 15 is of identical shape although with slightly reduced dimensions, as seen in FIG. 3A. Ratchet wheel 8 may thus slide axially along externally threaded rod 152 but relative rotation of the ratchet wheel 8 with respect to rod 152 is prevented. Thus, rotation or ratchet wheel 8 results in rotation of the externally threaded rod 152.

Cover 1 is removably frictionally attached to cover attachment portion 21 of the revolving sleeve 13. When attached, cover 1 completely encompasses brush 4, brush head 2 and operating cylinder 3 but does not directly contact any one of these structures. The significance of this will be explained below.

A liquid cosmetic, e.g. lip gloss, fills cosmetic reservoir 20 of the revolving sleeve 13. Cover 1 is snapped on one end of the revolving sleeve 13. Twisting of the revolving sleeve 13 with respect to cover 1 does not result in movement of ratchet wheel 8 or piston 15. This is because cover attachment portion 21 is the only structure engaged with cover 1 and rotation of cover 1 results in relative movement of only the cover 1 and revolving sleeve 13. Put another way, without relative rotation of cylinder 3 with respect to revolving sleeve 13 there can be no movement of ratchet wheel 8 or piston 15.

Figure 6A:
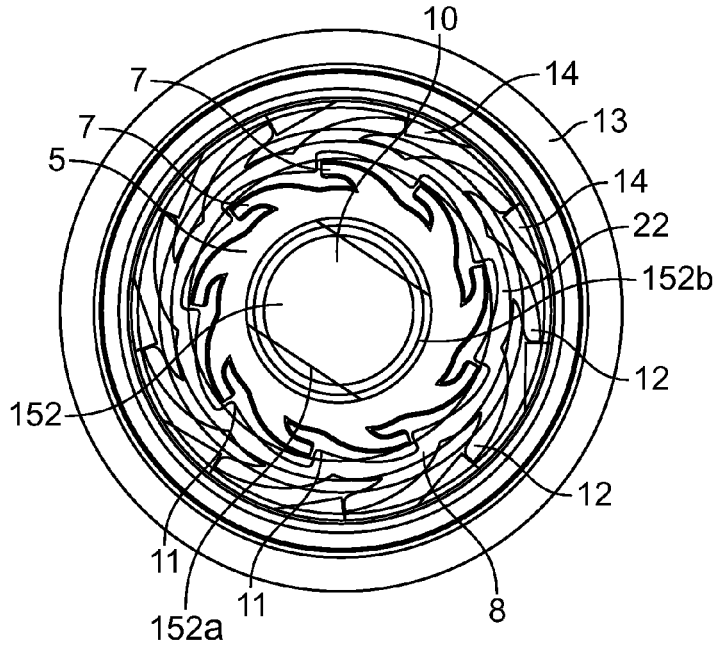
FIG. 6A is a schematic cross-sectional view taken along line A-A of FIG. 6.

After removing lid 1, counterclockwise rotation of revolving sleeve 13 (viewed from the top of the present cosmetic dispenser, i.e. the view of FIG. 6A) while holding cylinder 3 stationary results in piston head 151 being driven into cosmetic reservoir 20. This is due to: (1) the revolving sleeve ratchets 14 of the revolving sleeve 13 engaging the external ratchets 12 of the ratchet wheel 8 and causing ratchet wheel 8 to rotate counterclockwise; (2) externally threaded rod 152, trapped by its complementary cross section in racetrack shaped hole 10, being forced by ratchet wheel 8 to rotate counterclockwise; (3) externally threaded rod 152 displacing axially because of the relative rotation between rod 152 and complementary internally threaded through-hole 6 at the operating end 5 of cylinder 3; and (4) axial displacement of the externally threaded rod 152 pushing piston head 151 into cosmetic reservoir 20. The resultant pressure created by piston head 151 being displaced so as to reduce the volume of cosmetic reservoir 20 causes the liquid cosmetic to be forced through axial tunnel 16, central bore of needle 17 and into brush 4, such that it can be applied. In this cosmetic dispensing action, the internal ratchets 11 of the ratchet wheel 8 will pass over the operating end ratchets 7 at the operating end 5 without engaging these ratchets.

Revolving sleeve 13 clockwise, in the orientation of FIG. 6A, while holding operating cylinder 3 stationary results in no displacement of piston head 151 with respect to cosmetic reservoir 20. This is due to: (1) the external ratchets 12 of the ratchet wheel 8 passing over the revolving sleeve ratchets 7 without engaging these ratchets; (2) the internal ratchets 11 of the ratchet wheel 8 engaging the operating end ratchets 7; (3) cylinder 3, though stationary, rotating relative to the clockwise sleeve 13, this relative rotation of cylinder 3 with respect to sleeve 13 is counterclockwise; (4) this counterclockwise relative rotation, because internal operating end ratchets 7 engage the internal ratchets 11 of the ratchet wheel 8, resulting in counterclockwise rotation of ratchet wheel 8; and (5) whereby ratchet wheel 8 causing externally threaded rod 152, trapped by its complementary cross section in racetrack shaped hole 10, to rotate counterclockwise. Importantly, ratchet wheel 8 and, thus, externally threaded rod 152 are moving, relative to sleeve 13, in the same direction as through-hole 6 of operating end 5. This being the case, there is no relative rotation between the externally threaded rod 152 and the internally threaded through-hole 6 of operating end 5 and, thus, no resultant axial displacement of piston 15 and piston head 151. Thus, rotation of rotatable sleeve 13 clockwise relative to operating cylinder 3 results in no displacement of piston 15 and no reduction or enlargement of the volume of cosmetic reservoir 20.

The driving structures of the present invention may be implemented with plastic driving parts. The use of plastic is not a requirement, especially for parts of the driving structure that do not need to be resilient, e.g. internal ratchets of ratchet wheel 8 or revolving sleeve ratchets 7. The functionality of the relative clockwise or counterclockwise rotations of any portion of the present cosmetic dispenser is completely at the option of the designer. In addition, the present invention overcomes the shortcoming that the conventional lip pencil can only be made in cylinder type but not in other shapes.

An alternative embodiment of the cosmetic dispenser of the present invention allows only one direction of relative rotation of the operating cylinder 3 and revolving sleeve 5. Rotation in the opposite direction is prevented in this alternative embodiment. This alternative embodiment utilizes many of the same structures described above. Changes need only be made to the ratchet wheel and revolving sleeve ratchets to realize the single direction embodiment of the present invention.

Figure 8:
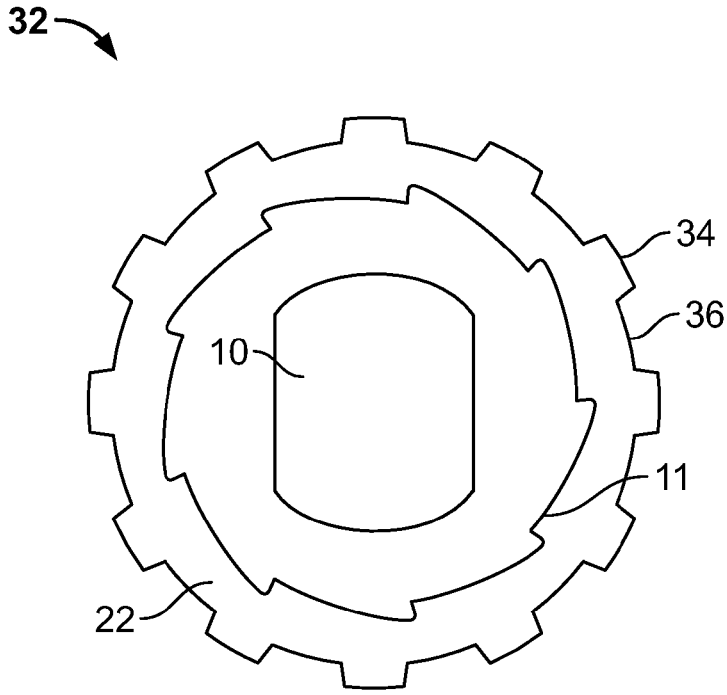
FIG. 8 is a schematic top view of another embodiment of the ratchet wheel.
Figure 8A:
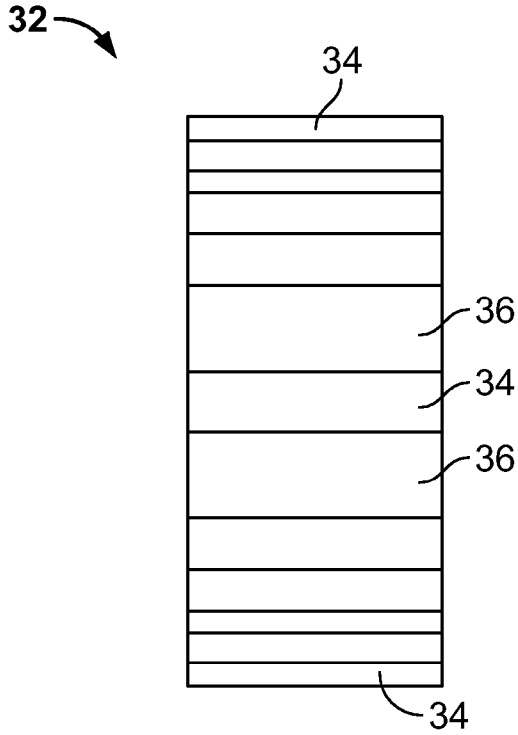
FIG. 8B is a schematic side view of the ratchet wheel of FIG. 8.
Figure 9:
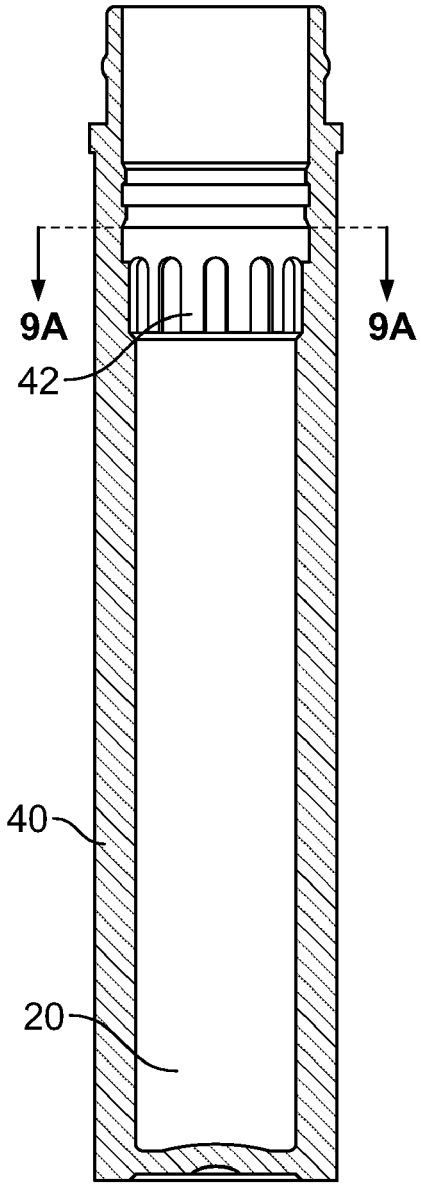
FIG. 9 is a schematic cross-sectional view of an alternative embodiment of the revolving sleeve.
Figure 9A:
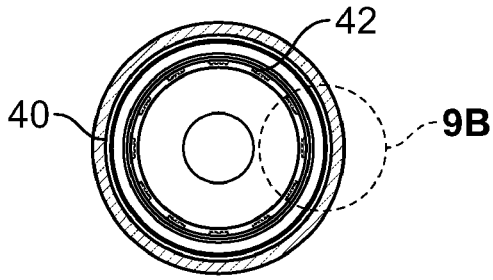
FIG. 9A is a schematic cross-sectional view taken along line A-A of FIG. 9.
Figure 9B:
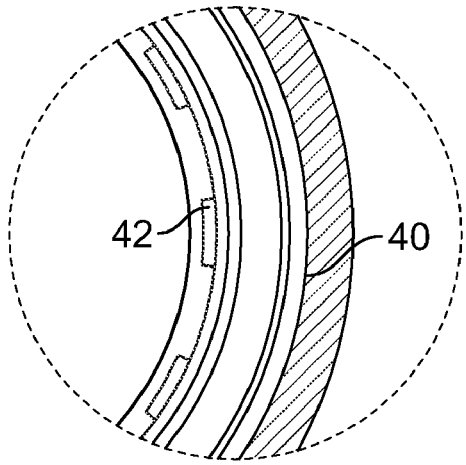
FIG. 9B is a detail view of FIG. 9A showing the revolving sleeve ratchets of the alternative embodiment.

FIGS. 8 and 8A show an alternative ratchet wheel 32 utilized in the single-direction embodiment of the present invention. Note that the external ratchets 12 of ratchet wheel 8 have been replaced by a square key 34 and notch 36 arrangement. FIG. 9 shows the alternative revolving sleeve 40 utilized with ratchet wheel 32. The revolving sleeve ratchets 14 have been replaced in this embodiment with a revolving sleeve engagement structure 42. The revolving sleeve engagement structure 42 receives the square key 34 and notch 36 structure of ratchet wheel 32. Once this complementary structure is engaged, it is not possible to twist ratchet wheel 32 relative to revolving sleeve 40. That is, rotation of revolving sleeve 40 in either direction must be accompanied by rotation of ratchet wheel 32 engaged therewith.

In the alternative embodiment of FIGS. 8 and 9, relative rotation of operating cylinder 3 and revolving sleeve 40 is only possible in one direction, i.e. the dispensing direction. Operating cylinder 3 is twisted relative to the revolving sleeve 40 in the dispensing direction and causes ratchet wheel 32 to rotate counter-clockwise direction (from perspective of FIG. 8). This counter-clockwise rotation of ratchet wheel 32 causes internal ratchets 11 of ratchet wheel 32 to pass over, i.e. resiliently displace and not engage, operating end ratchets 7. Although the operating end ratchets 7, operating end 5 and operating cylinder 7, do not rotate, racetrack shaped hole 10 of ratchet wheel 32 does rotate. Due to their complementary engagement, rotation of ratchet wheel 32 forces the rotation of externally threaded rod 152. The resultant rotation of externally threaded rod 152 relative to internally threaded through-hole 6 of operating end 5 causes the threads to engage and displacement of externally threaded rod 152. This displacement, by choosing the proper 'hand' of the engaging threads, forces piston head 151 to reduce the volume of cosmetic reservoir 20. In the same way described previously, this reduction in volume of cosmetic reservoir 20 causes cosmetic to be dispensed to brush 4.

Twisting operating cylinder 3 relative to the revolving sleeve 40 in the non-dispensing direction is not possible. This is because twisting ratchet wheel 32 in the clockwise direction (from perspective of FIG. 8) will cause internal ratchets 11 of ratchet wheel 32 to engage the operating end ratchets 7.

Because operating end ratchets 7 can not rotate independent of operating end 5 and operating cylinder 3, ratchet wheel 32 cannot turn in this non-dispensing, i.e. clockwise from perspective of FIGS. 8 and 6A, direction. Thus, revolving sleeve 40 cannot rotate relative to operating cylinder 3 in this non-dispensing direction.

While the particular example of the present invention as shown and described, it is understood, therefore, that this invention is not limited to the particular embodiment disclosed, but it is intended to cover variations and modifications of the structures, characteristics and principles within the spirit and scope of the present invention as defined by the appended claims.

What is claimed is:

1. A cosmetic dispenser comprising:

(a) a brush;

(b) cylinder having a first end and an operating end, an internally threaded hole passing through the operating end and operating end ratchets on an external surface of the operating end, the brush attached to the first end of the cylinder;

(c) a ratchet wheel having an annular wall and an end wall, the end wall having an axial hole therethrough; the annular wall comprising internal ratchets on an internal wall and external ratchets on an external wall; the operating end of the cylinder rotatably attached to the ratchet wheel such that the ratchet wheel internal ratchets are adjacent the operating end ratchets;

(i) the cylinder is rotatably attached to a revolving sleeve with the operating end and attached ratchet wheel disposed inside the revolving sleeve;

(d) a piston comprising an externally threaded rod, the rod slidingly engages the ratchet wheel axial hole and the external thread of the rod threadingly engaging the operating end internally threaded hole, the rod further having a distal end attached to a piston head, the piston head is disposed in the revolving sleeve;

(i) an axial tunnel extends substantially the entire length of the piston, through the rod and piston head, and communicates with the brush and a cosmetic reservoir defined by the revolving sleeve and piston head; and whereby, relative rotation of the cylinder and the rotating sleeve in a dispensing direction causes the ratchet wheel to turn the externally threaded rod and the engagement of the externally threaded rod with the internally threaded hole in the operating end, resulting in displacement of the piston head into the cosmetic reservoir and pressurized flow of a liquid cosmetic from the cosmetic reservoir through the piston axial tunnel into the brush.

2. The cosmetic dispenser of claim 1 wherein relative rotation of the cylinder and the rotating sleeve in a non-dispensing direction causes the ratchet wheel internal ratchets to engage the operating end ratchets and, thus, the ratchet wheel and the externally threaded rod may not be rotated and no displacement of the piston occurs.

3. The cosmetic dispenser according to claim 1, wherein the ratchet wheel axial hole is shaped like a racetrack, while the cross section of externally threaded rod is also shaped like a race track, thus enabling the relative rotational restriction and axial movement between the ratchet wheel and the rod.

4. The cosmetic dispenser according to claim 1, wherein the internal ratchets and the external ratchets of the ratchet wheel are elastic.

5. The cosmetic dispenser according to claim 1, further comprising a lid removably disposed over the brush.

6. The cosmetic dispenser according to claim 4, wherein the revolving sleeve further comprising a lid attachment portion and the lid removably attached to the lid attachment portion, whereby rotation of the lid relative to the revolving sleeve does not cause rotation of the cylinder relative to the revolving sleeve.

7. A cosmetic dispenser comprising:

(a) a brush attached to a first end of a cylinder;

(b) the cylinder also having an operating end and a threaded passage passing through the operating end, operating end ratchets are provided on an external surface of the operating end;

(c) a ratchet wheel having a cavity, internal ratchets, external ratchets and an end wall having an axial hole therethrough;

(i) the operating end of the cylinder extends into the cavity of the ratchet wheel such that the ratchet wheel internal ratchets are adjacent the operating end ratchets;

(d) the cylinder is rotatably attached to a revolving sleeve with the operating end and attached ratchet wheel disposed inside the revolving sleeve, the revolving sleeve having revolving sleeve ratchets on an internal annular wall adjacent the external ratchets of the ratchet wheel;

(e) a piston comprising a threaded rod and a piston head, the rod extends through the ratchet wheel axial hole and the operating end threaded passage with the rod threadingly engaging the operating end passage, the rod further having a distal end attached to the piston head, the piston head is disposed in the revolving sleeve;

(i) the ratchet wheel axial hole and rod comprise complementary cross sections such that relative rotational movement is restrained but relative axial movement is not restrained;

(ii) an axial tunnel extends the length of the piston, through the rod and piston head, and communicates with a cosmetic reservoir defined by the revolving sleeve and the piston head; and (f) a needle having a first needle end attached to the brush and a second needle end extending into the piston axial tunnel adjacent a proximal end of the rod;

whereby, rotation of the cylinder with respect to the rotating sleeve in a dispensing direction causes the revolving sleeve internal ratchets, through the ratchet wheel external ratchets, to turn the threaded rod and the engagement of the threaded rod with the threaded hole in the operating end, resulting in displacement of the piston head into the cosmetic reservoir and pressurized flow of a liquid cosmetic from the cosmetic reservoir, through the piston axial tunnel and needle, into the brush; and rotation of the cylinder with respect to the rotating sleeve in a non-dispensing direction causes the operating end external ratchets to turn the ratchet wheel by way of the ratchet wheel internal ratchets, thus resulting in no relative rotation between the threaded hole of the operating end, the ratchet wheel and the threaded rod and, thus, no displacement of the piston.

8. The cosmetic dispenser according to claim 7, wherein the ratchet wheel axial hole is shaped like a racetrack, while the cross section of externally threaded rod is also shaped like a race track, thus enabling the relative rotational restriction and axial movement between the ratchet wheel and the rod.

9. The cosmetic dispenser according to claim 7, wherein the internal ratchets and the external ratchets of the ratchet wheel are elastic.

10. The cosmetic dispenser according to claim 7, further comprising a lid removably disposed over the brush.

11. The cosmetic dispenser according to claim 10, wherein the revolving sleeve further comprising a lid attachment portion and the lid removably attached to the lid attachment portion, whereby rotation of the lid relative to the revolving sleeve does not result in rotation of the cylinder relative to the revolving sleeve.

12. A cosmetic dispensing device comprising:

(a) a cosmetic applicator attached to a first end of a cylinder;

(b) the cylinder also having an operating end and a threaded passage passing through the operating end, operating end ratchets are provided on an external surface of the operating end;

(c) a ratchet wheel having, internal ratchets, external ratchets and an wall having an axial hole therethrough;

(i) the operating end of the cylinder attached to the ratchet wheel such that the ratchet wheel internal ratchets are adjacent the operating end ratchets;

(d) the cylinder is rotatably attached to a revolving sleeve with the operating end and attached ratchet wheel disposed inside the revolving sleeve, the revolving sleeve having revolving sleeve ratchets on an internal annular wall adjacent the external ratchets of the ratchet wheel and a lid attachment portion;

(e) a piston comprising a threaded rod and a piston head, the rod extends through the ratchet wheel axial hole and the operating end threaded passage with the rod threadingly engaging the operating end passage, the rod further having a distal end attached to the piston head, the piston head is disposed in the revolving sleeve;

(i) the ratchet wheel axial hole and rod comprise complementary cross sections such that relative rotational movement is restrained but relative axial movement is not restrained;

(ii) an axial tunnel extends the length of the piston, through the rod and piston head, and communicates with a cosmetic reservoir defined by the revolving sleeve and the piston head; and (f) a needle having a first needle end attached to the cosmetic applicator and a second needle end extending into the piston axial tunnel adjacent a proximal end of the rod;

whereby, rotation of the cylinder with respect to the rotating sleeve in a dispensing direction causes the revolving sleeve internal ratchets, through the ratchet wheel external ratchets, to turn the threaded rod and the engagement of the threaded rod with the threaded hole in the operating end, resulting in displacement of the piston head into the cosmetic reservoir and pressurized flow of a liquid cosmetic from the cosmetic reservoir, through the piston axial tunnel and needle, into the cosmetic applicator; and the lid is disposed over the cosmetic applicator when the cosmetic applicator is not in use, the lid removably attached to the lid attachment portion of the revolving sleeve such that rotation of the lid with respect to the revolving sleeve does not result in rotation of the cylinder with respect to the sleeve.

13. The cosmetic dispenser according to claim 12, wherein the ratchet wheel axial hole is shaped like a racetrack, while the cross section of externally threaded rod is also shaped like a race track, thus enabling the relative rotational restriction and axial movement between the ratchet wheel and the rod.

14. The cosmetic dispenser according to claim 12, wherein the internal ratchets and the external ratchets of the ratchet wheel are resilient.

15. The cosmetic dispenser according to claim 12, further comprising a lid removably disposed over the brush.

16. The cosmetic dispenser according to claim 15, wherein the revolving sleeve further comprising a lid attachment portion and the lid removably attached to the lid attachment portion, whereby rotation of the lid relative to the revolving sleeve does not result in rotation of the cylinder relative to the revolving sleeve.

* * * * *